United States Patent [19]

Yeates

[11] 4,343,357

[45] Aug. 10, 1982

[54] DOWNHOLE SURGE TOOLS

[76] Inventor: Robert D. Yeates, 100 West Building, Midland, Tex. 79701

[21] Appl. No.: 195,825

[22] Filed: Oct. 10, 1980

[51] Int. Cl.[3] ..... E21B 23/04; E21B 33/12; E21B 34/10; E21B 34/14

[52] U.S. Cl. ..... 166/154; 166/156; 166/203; 166/318

[58] Field of Search ..... 166/153, 154, 155, 156, 166/185, 186, 188, 142, 203, 205, 317, 318

[56] References Cited

U.S. PATENT DOCUMENTS

| | | | |
|---|---|---|---|
| 2,071,390 | 2/1937 | Crowell | 166/154 |
| 2,128,253 | 8/1938 | Johnson | 166/317 X |
| 2,161,284 | 6/1939 | Crowell | 166/154 |
| 2,865,455 | 12/1958 | Rhoads, Jr. | 166/153 X |
| 2,998,075 | 8/1961 | Clark, Jr. | 166/318 |
| 3,542,130 | 11/1970 | Stout | 166/318 |
| 3,713,490 | 1/1973 | Watson | 166/154 X |
| 4,018,284 | 4/1977 | Perkins | 166/205 X |
| 4,142,583 | 3/1979 | Brieger | 166/318 X |
| 4,182,419 | 1/1980 | Yeates | 166/318 |
| 4,220,206 | 9/1980 | Van Winkle | 166/318 |

*Primary Examiner*—Stephen J. Novosad
*Assistant Examiner*—George A. Suchfield
*Attorney, Agent, or Firm*—J. Gibson Semmes; Joseph Shortill

[57] ABSTRACT

Downhole surge tool for completion and/or reworking of fluid-bearing wells, adapted to connection with the downhole end of a dry tubing string, the tool being actuated to provide an instantaneous full opening into the tubing of surging fluids and particulate matter inwardly from the formation and upwardly into the tubing. The downhole surge tool is characterized by its non-jammable assemblage, wherein its surge plug may not be completely reinserted upon the influence of a powerful or overwhelming backsurge. The tool includes a tubular nipple, ejectable surge plug, operably inserted into the nipple and an optional catcher sub, the plug including a positive ejection assembly which is actuated upon partial ejection of the plug, permitting limited re-entry only of the plug into the nipple. A seal is provided between the plug and the nipple, the seal being disposed above pressure relief ports within the surge plug. The positive ejection assembly of the plug includes two horizontally disposed pistons which are housed in opposed relationship within the lower end of the plug, the plug being seated and sealed within the nipple. The pistons being compressed against the inner surface of the nipple, a shearpin is installed to pass through the nipple walls and piston assembly.

6 Claims, 7 Drawing Figures

DOWNHOLE SURGE TOOLS

BACKGROUND OF THE INVENTION

The invention broadly relates to tools for use in completion or reworking fluid-bearing wells, and, more particularly to a tool assembly, connected to the downhole end of a dry tubing string, which is drop bar actuated to provide an instantaneous full opening into the tubing, surging fluids and particulate matter inwardly from the formation and upwardly into the tubing.

When sinking boreholes as source wells into rock strata having reservoirs of the desired fluids by the rotary drilling method, the commonly utilized liquid mixture, or drilling "mud", imparts fluid and solid losses into the rock reservoir matrix. While these losses may be relatively controlled, some degree of contamination and alteration is inherent in the drilling procedure, resulting in formation damage which limits productivity. When casing is cemented through the pay zone, additional damage occurs from losses of cement filtrate and whole cement. Although openhole completions and isolation tools can prevent cement contamination, the more common method of cementing casing across the zone of interest necessarily leads to contamination. Still other damage is produced by the mechanics of perforating through the casing necessary to open the pay zone. The tightly compacted linings of the perforation tunnels and shot debris restrict production inflow. Limited or unsuccessful penetration of the casing, cement sheath, and damage zone by the perforations add to the damage factor.

It is to the removal of formation damage through the means of a controlled and instantaneous release of the maximum differential pressure available that the present invention is primarily addressed.

Utilization of differential pressure techniques, per se, for mechanical advantage in well completion operations is known in the prior patented art. Swabbing is an early art form in which hydrostatic pressure is slowly relieved from the open reservoir. However, damage is not frequently removed by swabbing. Frangible discs, pressure relief valves, and recoverable plugs have been offered to accomplish limited tests and backsurging for damage removal in well completions. The prior art also reveals plugs of the knock-out variety which are activated by a weight dropped through the tubing string. Robert D. Yeates, U.S. Pat. No. 4,182,419 discloses such a plug, while Robert D. Yeates, U.S. Pat. No. 4,211,280 teaches a related method of completing a well. U.S. Pat. No. 4,151,881 to Armstrong also discloses a plug which is drop bar actuated to provide communication between the borehole and a dry tubing string. Another tubing bottom plug of this general type, which is run through tubing and utilized for related surging operations, is shown in U.S. Pat. No. 4,142,583 to Brieger. The present invention is an advancement over this previous art.

SUMMARY OF THE INVENTION

The present invention consists of a non-jammable downhole tool assembly which enables harnessing the maximum available reservoir potential to backsurge a fluid bearing formation which has been perforated or opened. Unlike ejectable plugs of the prior art, the surge plug of the present invention cannot be completely reinserted upon the influence of a powerful and overwhelming backsurge. Rather, under such conditions, only a partial reentry of the plug is possible, thus preserving continuity of the backsurge and the attendant flow of fluids and particulate matter from the formations as desired. Components of the invention include a tubular nipple, ejectable surge plug operably inserted into the nipple, and an optional catcher sub. The plug includes the positive ejection assembly which is actuated upon partial ejection of the plug to permit only a limited reentry of the plug back into the nipple. In the preferred embodiment, this positive ejection assembly is comprised of two horizontally disposed pistons which are housed in opposed relationship within the lower end of the plug. When the plug is seated and sealed within the nipple, the ends of the pistons are forcefully compressed against the inner surface of the nipple by the spring tension. A shear pin is then installed through the nipple walls and piston-spring assembly. After insertion of the plug, if desired, the optional catcher sub is attached to the lower end of the nipple. The entire assembly is then attached below a length of tubing and started into the well. A production packer is attached, followed by attachment of other appropriate fixtures, such as an on-off tool with a profile nipple. Production tubing is then added as the tools are progressively lowered down the casing to a level above the perforations.

If desired, the tubing may be hydrostatically tested into the well. Once positioned, the packer is set above the pay zone. Compensation is made for the packer set down weight or tension in anticipation of the tubing buoyancy to be released when the surge tools are actuated. The well is then completed for flow.

For realization of the maximum reservoir potential, the tools are activated by impact ejecting the plug with a bar weight dropped down the dry tubing. If a magnitude of backsurge less than the maximum is desired, a suitable water cushion may be placed into the tubing while running the tool string. In either mode of operation, downward travel of the plug exposes plural pressure relief ports in the nipple initiating communication from the well into the tubing. As the surge commences into the nipple ports, a partial vacuum occurs briefly under the plug. This momentary partial vacuum exerts a downward pull upon the plug which assists the bar momentum in clearing the plug from the nipple. As the plug continues its downward travel, the pistons clear the lower end of the nipple. This releases the spring tension forcing the pistons outwardly to an extended position. Upon the occurrence of a forceful backsurge, the extended pistons abut the lower end of the nipple, permitting only a partial reentry of the plug. However, the plug is not resealed, and pressure release and backsurge continue almost unabated through the nipple ports and about the plug itself. The dynamic flow about the plug occurs as a result of the clearance provided between the nipple interior and water courses located on the plug exterior. After dissipation of the backsurge, or when the well is closed in at the surface, the bar and plug fall into the casing or into the catcher sub, if employed. Both bar and plug may be recovered by fishing; the plug, however, being recoverable only after removal of the tubing.

If the catcher sub is utilized, the bar and plug are retained therein and recoverable when the tubing is removed from the well. When the catcher sub is not used, the plug may alternatively be constructed of aluminum for self-destruction in acid or corrosible well fluid, thusly negating removal by fishing.

In the preferred form of the invention, sealing between the plug and nipple occurs only about the lowest of two O-rings provided on the uppermost portion of the plug. As the assembly is lowered into the well, hydrostatic pressure about this lowest seal acts upwardly upon the plug. This pressure, which increases progressively with depth of fluid submergence forces tight engagement between an internal abutment of the nipple and plural chisel-edged contacts on the lower plug exterior. These chisel-edged contacts provide a minimum of metal-to-metal contact to prevent possible seizure and jamming of the plug by fluid seal. Vertical lands, which border the courses, extend downwardly from the contacts culminating generally in an apex on the partially rounded streamlined bottom of the plug. These features facilitate ejection of the plug by reducing the frictional drag and lift forces of the fluid stream. The intermediate portion of the plug is of reduced cross-sectional dimension to provide an open channel for fluid flow and frictionless contact with the nipple interior. The domed upper impact surface of the plug produces maximum utility of the available kinetic energy of the falling bar and provides further minimization of the surface contact friction between the plug and nipple.

The following preconditions are considered necessary in well selection for application of the present downhole surge tools and methods of operation:

(A) pay zone must have been perforated or opened prior to application;

(B) production tubing for the application must be free of internal scale or other obstructions and structurally resistant to common tensile loading and collapsing force;

(C) casing must be supported by cement from the casing shoe upward, to a level above the proposed packer seat;

(D) in deeper well applications, the production packer must be of the double-grip, heavy duty type, capable of being set in either tension or compression, and have an internal clearance which is sufficient to pass the drop bar and common fishing tools;

(E) for application of the synthesized energy-back-surging method, tubing weight must be greater than the resultant upward thrust of the bottomhole treating pressure, to prevent tubing buckling and other complications.

DESCRIPTION OF THE PREFERRED EMBODIMENT

Figure 5:
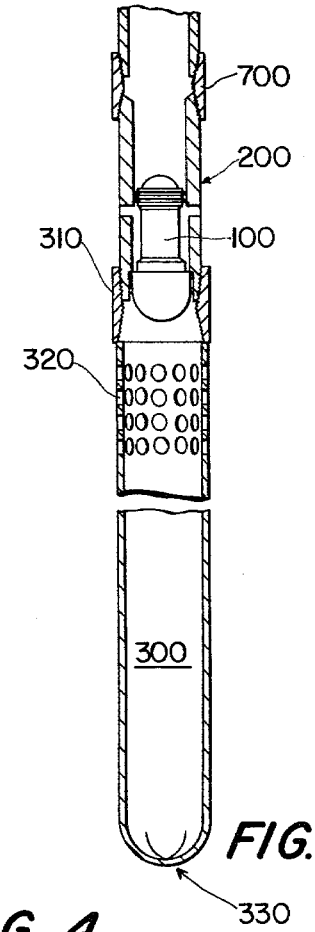
FIG. 5 is a view of the entire nipple-plug-catcher sub assembly shown in partial longitudinal cross-section.
Figure 6:
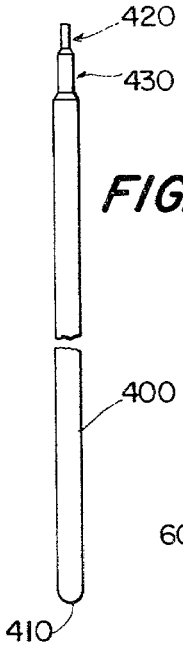
FIG. 6 is a profile view of the drop bar.

Referring initially to FIG. 5, the basic elements of the invention include the surge plug 100, the nipple 200, and the optionally usable catcher sub 300. The retrievable drop bar of FIG. 6 is dropped through tubing from the surface to impact actuate the tools. As previously noted, where it is desirable to realize less than the maximum reservoir potential, the plug may be ejected by filling the tubing with a suitable fluid and pumping at a pressure sufficient to overcome the hydrostatic and frictional forces which seat the plug within the nipple and to shear the fine brass pin. Plug construction may be of steel or high strength aluminum alloy.

Figure 1:
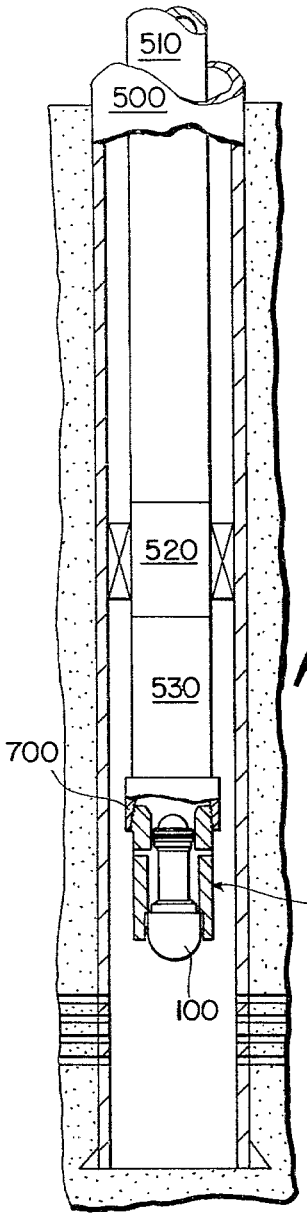
FIG. 1 is a schematic illustration of the invention disposed within a cased and perforated well.
Figure 2:
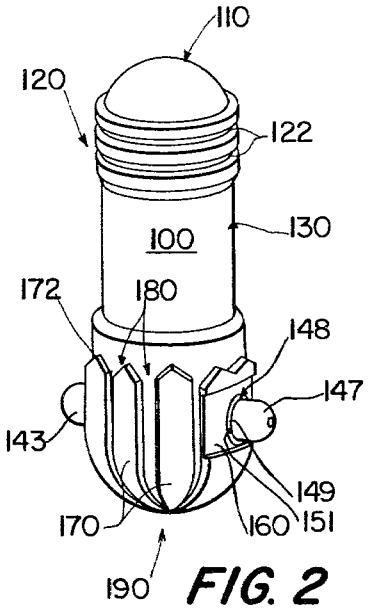
FIG. 2 is a view in perspective of the surge plug.

As shown in FIG. 2, the plug is generally circular in horizontal cross-section, having a rounded, or domed impact surface 110 at the upper end thereof. Immediately below impact surface 110 is the sealing portion 120 which includes two annular grooves 122 for receiving O-ring seals 124 (see FIG. 3). As shown most clearly in FIGS. 3 and 4, the cross-sectional dimensions of the plug, per se, at sealing portion 120 is less than any of the interior cross-sectional dimensions of the nipple 200. As will be explained more fully below, this relative relationship between the respective dimensions of the plug and nipple minimizes the frictional forces which must be overcome in ejecting the plug. When the plug is seated within the nipple, the O-rings 124 provide a secure hydrostatic seal between the plug and the nipple while the tool assembly is being positioned in the well as in FIG. 1.

Immediately beneath sealing portion 120 is an anti-friction portion 130, which is of lesser diameter than the sealing portion 120. As will be more fully developed below, this feature, in conjunction with the inner nipple bore serves to eliminate resistance to plug ejection by the bar and provides an enlarged flow channel for the surging fluid and particulate matter.

Figure 7:
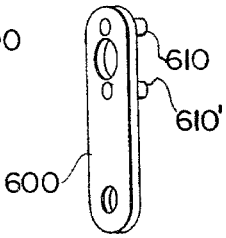
FIG. 7 is a view in perspective of the hand tool used for installation and removal of the positive ejection assembly.

The lower portion of the plug is, as shown, of a greater diameter and houses the positive ejection assembly 140. Referring to FIGS. 2 and 4, the positive ejection assembly includes safety piston 142 and safety retainer piston 144, said pistons being axially bored to receive a common shear pin 142'; steel spring 146, and the threaded piston retainer 148. This positive ejection assembly is contained within a housing 150 which is provided horizontally through the midsection of the lower portion of the plug. The piston-spring assembly is installed by hand and made secure by means of a special hand tool of FIG. 7. Safety piston 142 has an outwardly rounded extremity or detent 143 and an inner stem 145 which receives one end of the coil steel spring 146. The larger intermediate diameter of safety piston 142 abuts against an interior wall of the housing, limiting lateral movement of the piston. Safety piston 142 also extends through an opening in the plug housing. The other end of the piston spring abuts against the inner facing surface of the larger diameter of the safety retainer piston 144. Detent 147 of the retainer piston 144 extends through an opening provided in the threaded piston retainer 148. Threads on the outer circumference of retainer 148 engage internal threads disposed within the outer end of the housing 150. Suitable indentures 151 are provided on the exterior of the retainer 148 and are engaged by pins 610–610' of the hand tool 600 for installing the pistons and spring (see FIG. 7). As can be seen in FIG. 4, when the plug has been ejected, the respective detents 143 and 147 have a precise but limited lateral extension from the plug. For insertion of the plug, compression of the spring permits retraction of the detents 143 and 147 within the housing 150. After the plug has been assembled and inserted, a fine, brass shear pin is introduced through the nipple, both pistons and the spring in such a way as to prevent loss of the plug while installing surge tools in a well before fluid submergence occurs. The shear pin is fitted into nipple openings 290 and the piston 150 bore. See FIG. 3.

Figure 3:
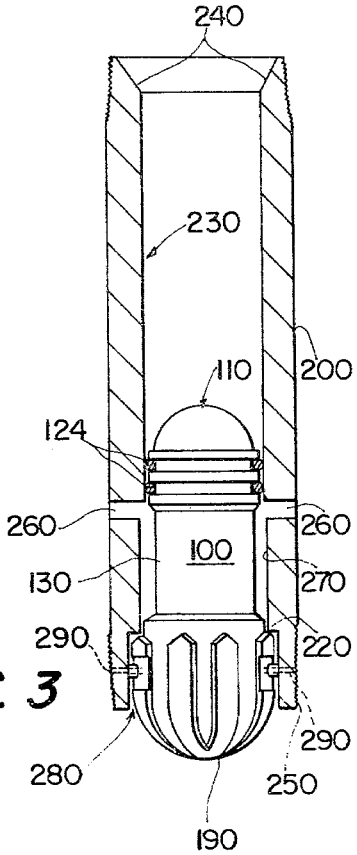
FIG. 3 is a side elevation of the surge plug seated within the nipple, the nipple being shown in cross-section.
Figure 4:
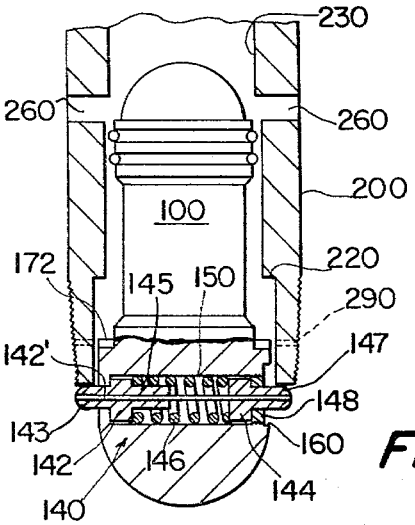
FIG. 4 is a longitudinal cross-section of the surge plug and nipple, illustrating operation of the positive ejection assembly.

When the plug is fully seated within the nipple as shown in FIG. 3, resiliency of the spring forces the pistons outwardly such that the detents impede against the interior wall of the nipple bore. In conjunction with the friction provided by the O-ring seals, the resultant spring tension provided by the compressed pistons 142 and 144 holds the plug in a balanced position within the nipple. Shear-pinning the plug into the nipple further secures its emplacement. Preferably, the dimensions of the plug are chosen such that the only lateral contact between the nipple and plug occurs at the O-ring seals 124 and the pistons 142 and 144, providing a minimum of friction to be overcome in ejecting the plug. As illustrated in FIGS. 2 and 4, a recess 160 is provided on the exterior of the plug adjacent the retainer 148. This recess prevents the retainer 148 from contacting the nipple bore during installation or operation.

The exterior of the lower portions of the plug includes a series of alternating lands 170 and vertical courses 180 (FIG. 2). The courses are cut along the length of this lower portion of the plug from the streamlined, circular bottom 190 thereof upwards. The upper end of the lands 170 terminate in respective chisel-edged contact surfaces 172, the locus of the tips of which form a horizontal plane. These chisel-edge contact surfaces abut against the plug restricting shoulder 220 of the nipple 200 when the plug is operationally inserted into the nipple The nipple 200 is machined with a polished, inner sealing, top bore diameter 230 of a dimension consistent with that of A.P.I. seating nipples. The upper end of the nipple has a 60° entrance bevel 240 and a threaded exterior which is adapted to engage coupling 700 (see FIGS. 1 and 5). As shown in FIG. 3, the entrance bevel 240 is adapted to guide the drop bar to a direct impact upon the dome 110 of the plug. At the bottom of the nipple, an external thread 250 is provided for connection of the coupling 310 of the catcher sub 300. When the catcher sub will not be utilized, nipple thread 250 is not necessary. A small, horizontally oriented bore 290 is provided in the lower end of the nipple, through the nipple walls and which can be aligned with the axial bore 150 of the surge plug and the bore through the safety pistons when the plug 100 is operationally inserted into the nipple 200, for insertion of the brass shear pin.

Plural pressure relief ports 260 are provided into the nipple in a horizontal plane which is located above the restricting shoulder 220. As shown in FIG. 3, when the plug is fully inserted and seated within the nipple, the lowermost O-ring seal 124 is positioned immediately above the plane of the pressure relief ports 260. It will be appreciated that this relative positioning between seals and the pressure relief ports 260 assures that a minimum amount of work will be required to initiate backsurge. As seen most clearly in FIG. 4, backsurge is initiated when the downward movement of the plug exposes the pressure relief ports 260.

The nipple is provided with three distinct internal bores which increase progressively in diameter from top to bottom of the nipple. As previously noted, the upper bore 230 is dimensionally consistent with an A.P.I. seating nipple. This upper bore extends from the lower edge of the beveled entrance 240 down to the upper limit of the pressure relief ports 260. The intermediate, or free flow, portion 270 of the nipple bore is, as shown in the drawings, of greater diameter than bore 230. This free flow portion lies between the center line of the uppermost plane of pressure relief ports 260 and the upper edge, or plane, of the restricting shoulder. This internal nipple diameter is greater than the external diameter of the non-compressed O-ring seals 124 upon the plug so that there is provided friction-free and unrestricted downward movement of the plug therethrough. This construction for bore 270, as well, forms, in conjunction with the adjacent friction-free portion 130 of the plug, an open channel for flow of surging material. These features thus serve to greatly reduce resistance, both mechanical and fluid, to plug ejection by the bar. The third, and lowermost, nipple bore 280 has the largest diameter and defines at the upper end thereof the restricting shoulder 220. This lowermost bore 280 is slightly larger than the cross-sectional dimension of the lowermost portion of the plug so that there is no surface contact therebetween, excepting where contacted by the safety pistons and shear-pin.

The length of the nipple 200 is not critical to the operation of these tools. A shorter length nipple, however, will suffice when the tools are to be used without the optional catcher sub. This reduces manufacturing costs. When the sub is used, a longer nipple is appropriate primarily because the extended length is desirable for provision of the external threads necessary on the lower end thereof for attachment of the sub (see FIG. 5).

The optional catcher sub 300 is of tubular steel construction and is generally of greater length than the drop bar and surge plug. A threaded coupling 310 secures the sub to the lower end of the nipple 200. Plural surge and production inlets 320 are provided in the upper end of the sub, just below the coupling 310. The size and number of these inlets are selected in relation to the cross-sectional area of the production tubing to be employed so that there will be no restriction of the fluid flow during surging or well stimulation procedures. That is to say, it is desirable that the sub shall not cause any surge reducing restriction to inflow from the formation or inappropriate restrictions to pumping through the inlets. Since the cross-sectional area of a given tubing is fixed, it can be seen that the number and size of the sub inlets are variable, the number of inlets depending upon the size selected. The inlet diameters are preferably smaller than the diameter of the plug safety pistons to prevent the possibility of jamming as the bar drives the plug with pistons extended down through the sub. For example, with one half inch pistons the sub inlets are each ⅜" in diameter and numerous enough such that the sum of the inlet areas exceeds the inner cross-sectional area of the production tubing to be used. This relationship is also to be observed when the tools are being utilized for downhole stimulation. For such operations, if the sub outlet area were less than the tubing I.D. area, a pressure drop at the sub would occur, producing undesirable results.

Accordingly, technicians monitoring the treatment at the surface could not distinguish between formationcaused and sub-caused pressure drop. Furthermore, if such a pressure drop occurred at the sub outlet, a screening out of solid materials carried in the treating fluid could occur, resulting in termination of the treatment.

The internal diameter of the sub is large enough to permit both surge plug and drop bar to fall freely without restriction. The external diameter of the sub is limited to provide sufficient clearance between the sub and casing 500 so that installation and retrieval are facilitated. The bottom of the sub 330 is preferably rounded to prevent contact with casing connections or adherence thereto while the tools are being lowered into a well.

The drop bar 400 of FIG. 6 is preferably of piston steel construction and of circular cross-section. A rounded bottom 410 is provided for "frictionless" fall through the tubing and impacting the dome 110 of the plug. The drop bar is provided with a small upper fishing neck 420 and a larger lower fishing neck 430 to give the user option as to the size and type of wireline or sandline fishing tools for bar recovery.

FIG. 1 illustrates disposition of the plug-nipple assembly within a cased and perforated well. As illustrated, the tools are held via coupling 700 on the string which comprises tubing joint 530, packer 520 and tubing 510. As the assembly is lowered beneath the liquid surface standing within the well, hydrostatic pressure acts upwardly through the courses 180 of the plug and through the ports 260 within the nipple. This pressure bears across the area provided by the upper nipple bore 230 at the lowest O-ring seal 124. The resultant buoyant force naturally increases with depth of submergence of the tools, tending to pull or lift the plug chisel-edge contact surfaces 172 into progressively tighter engagement with the restricting shouder 220 of the nipple.

Upon impact of the bar with the plug, the pin is sheared and the plug is moved downward ½ inch to expose the pressure relief ports 260 and to extend the safety pistons 142 and 144.

Pressure release and backsurge continue almost unabated through the pressure relief ports 260, and through the courses 180 and about the plug, washing out the O-rings. The enlarged flow channel created about the upper dome 110 of the plug and within the bore of the nipple permits the backsurge to continue dynamically up into the tubing.

As indicated in FIGS. 2 and 3, the plug is shear pinned into the nipple when assembled. This additional safety feature assures that rough handling by personnel will not cause premature loss of the plug during well installation. Occasionally, when the packer fixtures inherently fit tightly within the casing and the tubing must be pushed into the well, a non-shear pinned plug can be accidentally ejected from the nipple. This occurs when the tubing free-falls and is caught by the rig elevators. Such an occurrence is unlikely to impossible as the surge tools become progressively submerged in casing fluid.

I claim:

1. Apparatus for well completion and related downhole operations, wherein the well includes a bore and casing therefor, tubing within the casing, perforations or open hole and a packer for disposition between the tubing and casing, comprising:

(a) a tubular nipple having an upper end and a lower end, the upper end of the nipple having connection with the downhole end of the tubing, said nipple defining an internal abutment adjacent the lower end thereof, said nipple including plural pressure relief ports disposed above said internal abutment;

(b) an impact actuated surge plug, movably disposed within the lower end of the nipple, the uppermost portion of said plug extending beyond said pressure relief ports, said plug further including abutment means for complementary restraining engagement with the internal abutment of said nipple, said plug further including a positive ejection assembly, said positive ejection assembly being actuated upon partial ejection of said plug to permit only partial reentry of the plug into said nipple and thereby permit uninterrupted backsurge of the well;

(c) sealing means between said plug and said nipple said sealing means being disposed above said pressure relief ports; and, (d) wherein said positive ejection assembly is disposed substantially within a housing provided within said plug; and, (e) wherein the positive ejection assembly of said plug includes resilient engagement means for complementary effect with the lower end of said nipple.

2. The apparatus of claim 1 wherein said plug-nipple engagement means includes first and second piston members, said piston members being movably disposed within said housing for opposed movement relative to one another.

3. The apparatus of claim 2, wherein said first and second piston members each includes a detent surface which is extendable outwardly from said plug, each said detent surface and sealing means providing the only lateral contact of said plug with the interior surface of said nipple.

4. Apparatus of claim 3, wherein a vertical plane surface about the access opening of the safety piston housing is provided, such that contact between the threaded piston retainer ring and the nipple wall is prevented, eliminating installation and ejection restrictions.

5. Apparatus of claim 4 further comprising in combination a hand tool provided for securing the threaded piston retainer ring into the plug housing, said tool defining: a small, flat, elongated thin rigid plate, having a circular opening through one end such that it will slip over the piston-pin protruding from the plug housing, and two small, perpendicularly oriented pins, on the tool plate, oppositely positioned about the opening as described, such that the tool may insert into two equally spaced indentures disposed about the centrally located opening of the threaded retainer-washer element engaging the piston housing, and so that a clockwise torque may be applied by hand which will thereby tighten and secure the piston elements within the plug housing.

6. Apparatus for well completion and related downhole operations, wherein the well includes a bore and casing therefor, tubing within the casing, perforations or open hole and a packer for disposition between the tubing and casing, comprising:

(a) a tubular nipple having an upper end and a lower end, the upper end of the nipple having connection with the downhole end of the nipple having connection with the downhole end of the tubing, said nipple defining an internal abutment adjacent the lower end thereof, said nipple including plural pressure release ports disposed about said internal abutment;

(b) an impact actuated surge plug movably disposed within the lower end of said nipple, said surge plug including, between the upper and lower ends thereof, an anti-friction portion, said anti-friction portion being of lesser cross-sectional dimension than the interior cross-sectional dimension of said nipple, said plug including abutment means for complementary restraining engagement with the internal abutment of said nipple, said plug further including positive engagement means for complementary effect with the lower end of said nipple to permit only partial reentry of the plug into said nipple, said engagement means being disengaged from nipple upon partial ejection of said plug, thereby preventing plug reentry into nipple;

(c) sealing means between said plug and said nipple, said sealing means being disposed above said pressure relief ports; and, (d) wherein said resilient engagement means include first and second piston members movably disposed within said surge plug for opposed movement relative to one another; and, (e) wherein the nipple abutment means of said plug include plural chisel-edged contact surfaces, and wherein said surge plug further includes plural courses, said courses being in connection with said anti-friction portion and communicating the well bore interior therewith; and, (f) wherein the length of said plug is greater than any interior cross-sectional dimension of said nipple, or of the well casing of intended application; and, (g) further including a catcher sub secured to the lower end of said nipple, said catcher sub defining plural production apertures adjacent the top thereof.

* * * * *